United States Patent [19]

Pimlott

[11] Patent Number: 4,725,347

[45] Date of Patent: Feb. 16, 1988

[54] REINFORCED BIPOLAR ELECTROLYTIC CELL FRAME

[75] Inventor: John R. Pimlott, Sweeny, Tex.

[73] Assignee: The Dow Chemical Company, Midland, Mich.

[21] Appl. No.: 859,180

[22] Filed: May 2, 1986

[51] Int. Cl.[4] ..... C24B 9/00

[52] U.S. Cl. ..... 204/254; 204/279

[58] Field of Search ..... 204/279, 253–258, 204/263–266; 525/177, 187, 145, 122; 524/413, 451

[56] References Cited

U.S. PATENT DOCUMENTS

| | | | |
|---|---|---|---|
| 2,623,025 | 12/1952 | Dearing et al. | 524/451 |
| 2,912,402 | 11/1959 | Less et al. | 524/594 X |
| 3,635,877 | 1/1972 | Van Wyk | 524/594 X |
| 3,969,306 | 7/1976 | Borman et al. | 525/177 X |
| 4,097,446 | 6/1978 | Abolins et al. | 525/177 X |
| 4,195,458 | 4/1980 | Hoppe et al. | 524/594 X |
| 4,253,932 | 3/1981 | Mosé et al. | 204/279 X |
| 4,315,811 | 2/1982 | Kircher | 204/279 |
| 4,373,067 | 2/1983 | Dieck et al. | 525/177 X |
| 4,378,286 | 5/1983 | Eng et al. | 204/257 |
| 4,378,402 | 3/1983 | Below | 524/594 X |
| 4,402,813 | 9/1983 | Kircher et al. | 204/279 |
| 4,558,089 | 12/1985 | Koyama et al. | 525/145 X |
| 4,571,288 | 2/1986 | Boulton | 204/255 X |
| 4,654,134 | 3/1987 | Morris et al. | 204/279 X |

*Primary Examiner*—Donald R. Valentine

*Attorney, Agent, or Firm*—Andrew E. Pierce

[57] ABSTRACT

An improved frame useful in a filter press type electrolytic cell having a channel of U-shaped configuration and filled with a mixture of a thermosetting resin and a filter. The frames can be used in an electrolytic cell for the electrolysis of brine to produce chlorine and caustic.

12 Claims, 5 Drawing Figures

REINFORCED BIPOLAR ELECTROLYTIC CELL FRAME

BACKGROUND OF THE DISCLOSURE (1) Field of the Invention

This invention relates to reinforced cell frames for use in filter press type electrolytic cells.

(2) Description of the Prior Art

The prior art has given considerable attention to the electrode coating materials, the diaphragm or iron exchange membrane composition, and the like. As a result very little attention has been directed to much needed improvements aimed at reducing the cell frame cost and to means and methods for improving the same in the area of filter press type electrolytic cells. In filter press type cells, the frame material is generally thick and of solid construction since the frame is under considerable compressive force when assembled into a multiple unit filter press cell. When the filter press type cell is operated under greater than atmospheric pressure even greater compressive forces are applied to the frame than when the cell is operated under atmospheric pressure.

Electrode sections for filter press type cells are generally employed as large planar surfaces in order to economically use the metal mesh forming the electrode as well as the planar membranes, and because of the very high cost of present filter press cell construction materials such as titanium, ruthenium, nickel, fluorocarbon and carboxylic acid substituted polymer membranes, it is highly desirable to maximize current densities and to reduce voltage coefficients in operating chlor-alkali cells so as to best utilize the mechanical and electrical advantage of the materials of construction employed.

Prior art cell frame construction has used heavy member construction and/or cylindrical shape. Heavy walled construction either with solid, electrolyte resistant metals such as titanium and nickel or steel lined with an electrolyte resistant metal is expensive and consumes large amounts of metal. For these reasons chlor-alkali cells of the filter press type have not been extensively utilized. Generally, filter press type chlor-alkali cells are constructed so that the ion exchange membranes are clamped under pressure between flanges of the filter press frames. Filter press cells are usually of the bipolar type.

Early filter press type ion exchange membrane type cells were constructed of heavy plastic frames. Generally these cells were of the bipolar type which utilized a solid sheet or back plate which functioned as a divider between the cells and was fabricated integrally with the frame. Bipolar cells of this type followed the well developed filter press fabrication principles. The integral frame-back plate construction provided excellent stiffening of the frame structure. The frames for these cells were molded from hard rubber, filled polypropylene, polyester-fiberglass, polyester or any other material that was chemically resistant to the cell environment. Generally, the anode frame was formed of these plastic materials while the cathode frame was formed from steel. The size of filter press type ion-exchange membrane cells tends to be limited in size by the high cost for very large molds and the tendency for warping that tends to occur in heavy plastic frames when the frames are subjected to operating temperatures during actual cell use. The plastic parts employed in these cells tend to have a high coefficient of expansion compared to the electrodes and other metal parts of the cells. Distortion is caused within the cell when the various parts expand or contract at different rates. Filled plastic frames are susceptible to corrosion by chlorine especially when the filler material is a material such as calcium carbonate. In addition, the presence of calcium and magnesium in these plastic frames has been found to be detrimental because of the adverse effect of these elements on ion-exchange membrane life.

Therefore, because of such deficiencies, present day filter press ion exchange membrane cells generally employ metal frames. Generally the metal frames are made of titanium on the side of the frame facing the anode and nickel on the side of the frame facing the cathode. Metal frame construction provides advantages in high strength, small cross sectional area in the structural members, corrosion resistance, resistance to warping and compatibility with respect to coefficient of expansion with metal electrode surfaces. The very high fabrication cost of metal frames has led to attempts to reduce the cost such as by the employment of plastic frames which will give the advantages that metal frames offer without the high cost.

In U.S. Pat. No. 4,402,813, Kircher et al disclose a composite fiber reinforced plastic frame wherein a thin corrosion resistant liner material having a highly reinforced structural core is partially formed by wrapping roving layers of glass fiber impregnated with a catalyzed thermosetting resin having high strength and a low coefficient thermoexpansion.

In U.S. Pat. No. 4,378,286, Eng et al disclose a filter press type electrolytic cell for the electrolysis of brine having a plurality of rectangular frames having U-shaped or channel-shaped walls, the open side of each of which wall members face inwardly. Cross members partially cover the openings of the framing walls to reduce distortion during closing of the cell. In U.S. Pat. No. 4,315,811, Kircher discloses a reinforced metal cell frame having U-shaped channels which provide resistance to compression.

SUMMARY OF THE INVENTION

The present invention is a novel frame for use in a filter press type, ion-exchange membrane electrolytic cell incorporating a corrosion resistant liner and an inexpensive, but high compressive strength, structural core. The liner is a corrosion resistant, metal or plastic and is formed in a U-shaped or channel-shaped configuration into which a core material, which is a reinforcing mixture of a thermosetting resin and a filler, is applied. Preferably, the openings in the cell frame face outwardly. Generally, the core material is a mixture of a filler and a polymer which are each resistant to the corrosive environment of the cell.

DETAILED DESCRIPTION OF THE INVENTION

Figure 1:
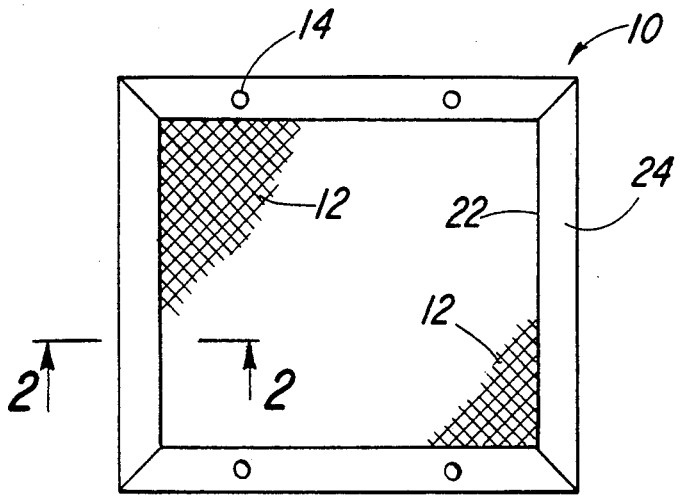
FIG. 1 is a side elevational view of an electrolytic cell frame adapted for use in a filter press type electrolytic cell. The associated electrode surface is shown broken away.
Figure 2:
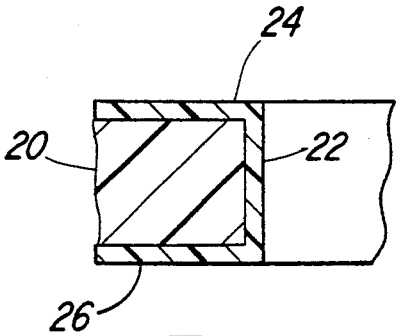
FIG. 2 is a sectional view taken along the lines 2—2 of FIG. 1 showing one embodiment of the frame member structure.

Referring now to FIG. 1, a frame which is useful in a filter press type electrolytic cell is indicated generally by the numeral 10. Frame 10 includes a generally rectangular frame structure comprised of three members specifically shown in a cross sectional view taken along lines 2—2 of FIG. 1. In FIG. 2, members 22, 24, and 26 form a U-shaped frame member. The frame member 10 can be of a metal or plastic which is resistant to exposure to chemicals with which the frame members come into contact under operating conditions of the electrolytic cell. As shown in FIG. 2, the opening of frame member 10, which faces outwardly, is filled with mixture 20 comprising a thermosetting resin and a filler.

Figure 3:
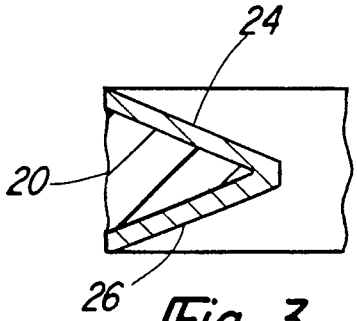
FIG. 3 is a sectional view taken along lines 2—2 of FIG. 1 showing an alternative embodiment of the structure of the frame member of the invention.

In FIG. 3 there is shown in cross section taken along line 2—2 another embodiment of frame member 10 which is generally a triangular shaped frame structure comprised of two members shown as 24 and 26 forming a channel which faces outwardly.

Figure 4:
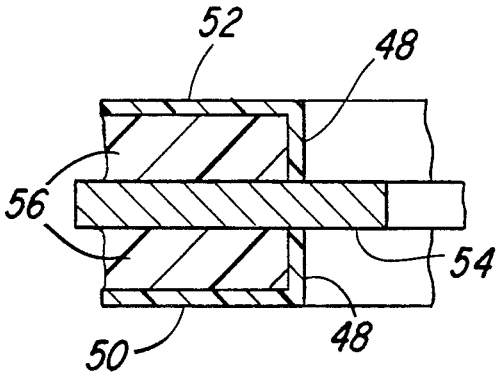
FIGS. 4 and 5 are partial sectional views showing another embodiment of the invention wherein the frame is stiffened by and surrounds a portion of a metallic center board.

In FIG. 4 there is shown in a cross sectional view another embodiment of the filter press type electrolytic cell frame of the invention having a stiffening center board 54, preferably made of a metal, around a portion of which frame liners 50 and 52 are placed so as to enclose a space between the center board support structure and liners 48, 50, and 52. This is filled with a core material 56 comprising a thermosetting resin and a filler. The portion of the liner facing the anode is generally made of titanium, while the portion of the liner facing the cathode is made of steel.

Figure 5:
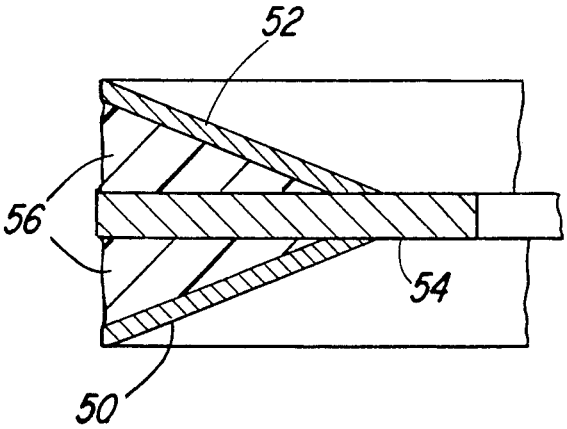

An alternative embodiment of the centerboard supported frame of the invention is shown in FIG. 5 in a cross sectional view. Liners 50 and 52 partially surround and are supported by centerboard 54. Core material 56 fills the spaces between the liners 50 and 52 and centerboard 54.

The core material 20 in FIG. 2 and 56 in FIG. 3 is formed of a mixture of a chemically resistant filler and a thermosetting resin such as a polyester, a polyether resin, a phenolic, or an epoxy resin. The filler materials useful can be particulate or fibrous and are illustrated by such chemically inert materials as sand, talc, titanium dioxide, chopped glass fibers or a chopped fibrous halocarbon polymer such as polytetrafluoroethylene fibers. The proportion of filler utilized in admixture with the thermosetting resin for the formation of the core material can be about 50 to about 95% by weight, preferably about 60 to about 85% by weight and most preferably, about 70 to about 80% by weight.

The materials of construction for the frame assembly of the invention will be those materials which are capable of withstanding exposure to chemicals with which they come into contact under the operating conditions of the electrolytic cell. Thus the frame components for use, for example, in a chlor-alkali electrolytic cell which are in contact with the anolyte, will be such as to be capable of withstanding the action of alkaline and/or acid brines in the presence of chlorine, while the frame components in contact with the catholyte will be such as to be capable of resisting the corrosive attack of caustic mixtures. Generally the frame components in contact with the anoltye will be of titanium, tantalum, titanium clad copper or steel or other such metal or suitable material and the portion of the frame in contact with the catholyte will often be of steel, nickel, stainless steel (high chromium or high nickel content) nickel clad steel, nickel clad copper, stainless steel on copper or stainless steel on steel.

The frame liner can also be made of various synthetic organic polymers. For example the frame liner can be made from a hydrophobic polymer, for example, a polyolefin or a thermoplastic halocarbon polymer. Polytetrafluoroethylene or polypropylene are the most preferred polymers for use in the preparation of the frames of the invention but if desired other hydrophobic polymers can be used instead such as a polymer of fluorinated ethylene propylene, polyvinylidene chloride, polyvinyl dichloride, and polyvinyl difluoride. The use of thermoplastic polymers for the formation of the liner portion of the frame of the invention allows the use of extruded portions of the liner component of the frames of the invention which can be readily assembled into the rectangular shaped frame and thereafter filled with a mixture of a thermosetting polymer and a filler.

The thickness of the frame of the invention must be calculated for the specific design of the filter press electrolytic cell. In this respect, the gasket pressure required is perhaps more significant a design factor than hydraulic pressure. In general, the thickness of the frame liner material is in the range from about 0.01 to about 0.25 inches and preferably from about 0.02 to about 0.15 inches. Generally, the overall thickness of the frame, including the core material, is in the range of about 1 to about 10 centimeters, preferably about 1.8 to about 6 centimeters and more preferably about 2.5 to about 5 centimeters.

The openings required in the sides of the frame of the invention for inlets, outlets, and conductors tend to reduce the strength of the frame at the points of passage. Without the use of a metallic or plastic channel filled with core material as a component of the frame, electrode sections considerably thicker than the size of the frame specified above might be required simply to provide adequate frame strength. Frame liner formed into channels from sheet materials have advantages over solid constructions in that the flanges of the liner material forming the channel of the frame are inherently thin and thus the strength of the liner material is not reduced appreciably by penetration of the channel for inlets, outlets, and conductors. In addition, the core material which can be formed in place in the channels formed by the liner materials of the frame provide increased strength. The net result can be the use of a thinner electrode and therefore a less expensive cell on a unit basis.

The relative dimensions of the various parts of the frame of the invention can be changed to accommodate different electrolytic processes. For instance, different shapes of the frame channels can be used and modifications can be made in the methods of sealing the frames utilizing gasketting material without losing the prime advantages of the frame of the present invention, namely a strong filter press type cell frame made of either an electrically conductive metal liner and a thermosetting polymer/filler core material or a cell frame made of an organic polymer liner material with a thermosetting polymer/filler core material. Both types of filter press type cell frames are not subject to corrosion even over lengthy operating periods and yet are economical to produce.

In operating a filter press type cell utilizing the frame of the invention, normal filter press type cell operating conditions are employed. Thus the operating voltage for the electrolysis of a brine solution, for example, can be about 2.9 to about 4.5 volts with a current density of about 0.2 to about 0.5 ampere/sq. centimeter in a 10 to 15 kiloampere monopolar cell equipped with a dimensionally stable ruthenium oxide coating on a titanium anode, a steel cathode, and a permselective membrane. In such an electrolytic cell, operation is conducted utilizing a saturated or nearly saturated brine feed, with a depletion in sodium chloride content of the anolyte of about 35 to 120 grams per liter to produce a catholyte containing 12 to 50% sodium hydroxide and 50 to 90 parts per million of sodium chloride and chlorine containing about 0.5 to about 1 volume percent of oxygen. Such cells can be operated continuously for periods of a year or more without experiencing objectional corrosion of the metal frames of the invention.

While this invention has been described with reference to certain specific embodiments, it will be recognized by those skilled in the art that many variations are possible without departing from the scope and spirit of the invention, and it will be understood that it is intended to cover all changes and modifications of the invention disclosed herein for the purposes of illustration which do not constitute departures from the spirit and scope of the invention.

The embodiments of the invention in which an exclusive property or priviledge is claimed are defined as follows:

1. A frame for a filter press type electrolytic cell having unitary framing members in which U or channel shaped openings are formed, wherein said frame is reinforced by filling said openings in said frame with a mixture comprising a thermosetting resin and a chopped fibrous or particulate filler and said thermosetting resin and said filler are resistant to anolyte and catholyte liquids in said electrolytic cell wherein said mixture is in direct contact with said frame.

2. The frame of claim 1 wherein said framing members are metal or a hydrophobic polymer, having the openings of said U shaped or channel members facing outwardly, and said thermosetting resin and said filler are resistant to anolyte and catholyte liquids in a chlor-alkali electrolytic cell.

3. In a bipolar filter press type electrolytic cell for electrolysis of an aqueous salt solution comprising a plurality of unitary frames having electrodes in association therewith and separated from each other by membranes, diaphragms or microporous separators, which form a plurality of anolyte and catholyte compartments, the improvement comprising using said frames having U or channel shaped openings, said openings being filled with a reinforcing mixture of a thermosetting resin and a chopped fibrous or particulate filler wherein said mixture is in direct contact with said frame.

4. The elctrolytic cell of claim 3 wherein said openings face outwardly, said frames are of metal and said reinforcing mixture and frames are capable of withstanding exposure to chemicals with which they come into contact under operating conditions of said electrolytic cell.

5. The electrolytic cell of claim 4 wherein said reinforcing mixture comprises a thermosetting resin selected from the group consisting of polyesters, polyethers, phenolics, and epoxy resins and wherein said filler is selected from at least one of the group consisting of sand, talc, titanium dioxide, a polyolefin, and glass.

6. The electrolytic cell of claim 5 wherein said reinforcing mixture comprises about 50 to about 95% by weight of said filler.

7. The electrolytic cell of claim 6 wherein said frame is a metal selected from the group consisting of titanium, tantalum, titanium clad copper or steel, stainless steel, nickel clad steel, nickel clad copper or steel, stainless steel on copper and stainless steel on steel.

8. A frame for a filter press type electrolytic cell comprising top, bottom, and side framing members in which side framing members form U or channel shaped openings which face outwardly, wherein said framing members surround a portion of a stiffening centerboard and said frame is reinforced by filling said openings in said frame with a mixture comprising a thermosetting resin and a filler and said thermosetting resin in said filler are resistant to anolyte and catholyte liquids in a chlor-alkali electrolytic cell.

9. The frame of claim 8 wherein said centerboard is made of a metal and said thermosetting resin is selected from the group consisting of a polyester, a polyether, a phenolic, and an epoxy resin and said filler is selected from the group consisting of at least one of sand, talc, titanium dioxide, a polyolefin and glass.

10. The frame of claim 9 wherein the proportion of said filler is about 50 to about 95% by weight.

11. The frame of claim 10 wherein said frame is a metal selected from the group consisting of titanium, tantalum, titanium clad copper or steel, steel, nickel clad steel, nickel clad copper or steel, stainless steel on copper and stainless steel on steel.

12. The frame of claim 10 wherein said frame is a thermoplastic hydrophobic polymer selected from the group consisting of a polyolefin, polyvinylidene chloride, chlorinated polyvinyl chloride, polyvinyl difluoride, and polyvinyl dichloride.

* * * * *

UNITED STATES PATENT AND TRADEMARK OFFICE

CERTIFICATE OF CORRECTION

PATENT NO. : 4,725,347

DATED : February 16, 1988

INVENTOR(S) : John R. Pimlott

It is certified that error appears in the above-identified patent and that said Letters Patent is hereby corrected as shown below: On The Title Page:

Cover page, 4th line of the Abstract, "filter" should read -- filler --.

Col. 4, line 31, "more" should read -- most --.

Col. 5, line 12, "50%" should read -- 40% --.

Col. 6, line 2 (in Claim 3), after "said" insert -- reinforcing --;
line 4 (in Claim 4), "elctrolytic" should read -- electrolytic --.

Signed and Sealed this

Twenty-fifth Day of October, 1988

*Attest:*

DONALD J. QUIGG

*Attesting Officer*

*Commissioner of Patents and Trademarks*